US005380012A

United States Patent [19]

Jones et al.

[11] Patent Number: 5,380,012

[45] Date of Patent: Jan. 10, 1995

[54] METHOD FOR PLAYING A CARD GAME

[76] Inventors: Daniel A. Jones, 5520 W. Del Rey, Las Vegas, Nev. 89102; Albert J. Ethier, 10339 Scott Ave., Whittier, Calif. 90603

[21] Appl. No.: 140,688

[22] Filed: Oct. 21, 1993

Related U.S. Application Data

[60] Continuation-in-part of Ser. No. 74,301, Jun. 9, 1993, which is a continuation-in-part of Ser. No. 800,631, Nov. 27, 1991, Pat. No. 5,288,077, which is a continuation-in-part of Ser. No. 361,276, Jun. 5, 1989, Pat. No. 5,078,405, which is a division of Ser. No. 214,934, Jul. 5, 1988, Pat. No. 4,861,041, which is a continuation-in-part of Ser. No. 182,374, Apr. 18, 1988, Pat. No. 4,836,553.

[51] Int. Cl.[6] ..... A63F 1/00

[52] U.S. Cl. ..... 273/292; 273/274

[58] Field of Search ..... 273/292, 274, 309, 85 CP

[56] References Cited

U.S. PATENT DOCUMENTS

| | | | |
|---|---|---|---|
| 1,238,736 | 9/1917 | Barrett | 193/2 |
| 1,527,929 | 2/1925 | Simons | 273/274 |
| 1,763,476 | 6/1930 | Morris | 273/309 |
| 3,269,503 | 8/1966 | Foster | 273/85 CP |
| 3,663,021 | 5/1972 | Whippo | 273/292 |
| 3,667,757 | 6/1972 | Holmberg | 273/274 |
| 3,825,255 | 7/1974 | Kennard et al. | 273/138 A |
| 3,876,208 | 4/1975 | Wachtler et al. | 273/138 A |
| 4,232,866 | 11/1980 | Pennachio | 273/374 |
| 4,305,586 | 12/1981 | Richards | 273/274 |
| 4,364,567 | 12/1982 | Goott | 273/237 |
| 4,397,469 | 8/1983 | Carter, III | 273/149 R |
| 4,518,001 | 5/1985 | Branham | 133/5 R |
| 4,531,187 | 7/1985 | Uhland | 364/412 |
| 4,614,342 | 9/1986 | Takashima | 273/85 CP |
| 4,648,604 | 3/1987 | Horan | 273/292 |
| 4,651,997 | 3/1987 | Wood | 273/274 |
| 4,759,549 | 7/1988 | Beckwith | 273/274 |
| 4,760,527 | 7/1988 | Sidley | 364/412 |
| 4,813,675 | 3/1989 | Greenwood | 273/138 A |
| 4,836,553 | 6/1989 | Suttle et al. | 273/292 |
| 4,837,728 | 6/1989 | Barrie et al. | 364/412 |
| 4,861,041 | 8/1989 | Jones et al. | 273/292 |
| 4,948,134 | 8/1990 | Suttle et al. | 273/85 CP |
| 5,022,653 | 6/1991 | Suttle et al. | 273/85 CP |
| 5,078,405 | 1/1992 | Jones et al. | 273/309 |
| 5,112,060 | 5/1992 | Jones | 273/309 |

FOREIGN PATENT DOCUMENTS

| | | | |
|---|---|---|---|
| 338644 | 10/1989 | European Pat. Off. | 273/292 |
| 2830216 | 1/1980 | Germany . | |
| 2184029 | 6/1987 | United Kingdom . | |

OTHER PUBLICATIONS

Scarne's Encyclopedia of Games "Stud Poker", Harper & Row Publishers, 1973, pp. 34–41.

Casino Journal, vol. 8, No. 12, Dec. 1992 "Working within the systems: IGT's linked progressive programs take leap to the tables" pp. 10–15, 40, 41.

Casino Gaming Sep. 1988 pp. 12–13 "Aruba Deals a New Game: Caribbean Stud Poker".

State of New Jersey Casino Control Commission PRN 217205 Civil Action IGT's second amended petition for the authorization for the implementation of the game of progressive-21 filed some time after Aug. 4, 1992.

Information Discosure statement Apr. 7, 1988 desribing "Sklansky'Casino Poker" and Video Poker.

Coin Hopper Model CH-500 and Model Number DH-750/UI literature Asahi Seiko 26 Jan. 1993.

Statement of Grounds and Particulars by John Huxley Ltd In opposition to Australian patent application No. 628044.

*Primary Examiner*—Benjamin H. Layno

[57] ABSTRACT

The disclosed card game variant enables players to compete in the familiar format of a rummy-type game against other players in a live cardroom format. In a preferred seven-card embodiment, players initially ante, then receive two cards face down and one card face up from a non-playing dealer. Players electing to continue play after a forced bet or fold option each receive additional cards, one at a time with each card followed by a betting round, to complete a seven card hand consisting of three face down cards and four face up cards. The point count totals of the hands of each remaining player are then determined and compared, with each Ace counting 1, each deuce counting 2, etc., and with tens and face cards each counting 10. Each spread consisting of three or more suited cards in sequence or three or four of a kind counts zero (0). The object of the game is to have the lowest point count total, and the winning player(s) are awarded the accumulated wagers or pot.

58 Claims, 1 Drawing Sheet

METHOD FOR PLAYING A CARD GAME

CROSS-REFERENCE TO RELATED APPLICATIONS

This is a continuation-in-part of application Ser. No. 08/074,301, filed Jun. 9, 1993; which is a continuation in part of application Ser. No. 07/800,631, filed Nov. 27, 1991 now U.S. Pat. No. 5,288,077; which is a continuation-in-part of application Ser. No. 07/361,276, filed Jun. 5, 1989 and now U.S. Pat. No. 5,078,405; which is a division of application Ser. No. 07/214,934, filed Jul. 5, 1988 and now U.S. Pat. No. 4,861,041; which is a continuation-in-part of application Ser. No. 07/182,374, filed Apr. 18, 1988 and now U.S. Pat. No. 4,836,553. The entire disclosures of each of the above referenced applications and patents are hereby incorporated by reference herein.

BACKGROUND OF THE INVENTION

The present invention relates to games, and more particularly pertains to a new type of card game especially adapted for casino gambling, particularly in a live cardroom format.

As a leisure time activity, poker and other card games have fascinated the public for years. A deck of cards, a playing surface and a few participants are all that is needed to provide a recreational few hours away from the stress and strain of daily life. Almost everyone knows how to play some variation of a rummy-type card game in which players attempt to acquire 3 or more card suited runs (such as 4 club, 5 club, 6 club) and sets of 3 or 4 of a kind (such as 4 club, 4 diamond, 4 spade) in order to make a play or so-called "spread".

Many places, both within and without the United States, have legalized gaming and poker is one of the games of chance that is offered in both casinos and cardrooms. In a conventional cardroom poker game, the house provides a dealer, the playing cards, the table and chairs but does not play a hand. The house collects a nominal percentage of each player's bet (the "rake") which compensates the house for providing the facilities to the players. Alternatively, the house may charge each player a set amount per hand or for a specified length of time, say one-half hour. Each player is competing not against the house, but against all the other players with the highest hand winning the total of all the wagers made on that hand.

A conventional poker game, known as "Seven Card Stud" is played in a live cardroom format in which up to seven players each initially place ante wagers and then receive two cards face down and one card face up in an initial three card deal. An initial betting round then takes place, with the player having the highest card typically betting first, with the other players following in rotation. Four additional cards are then dealt in a one at a time manner, with each card followed by a betting round, until remaining players have completed hands consisting of three face down cards and four face up cards. The best five cards of each remaining player hand are then compared using conventional poker rank as the criteria for comparison to determine a winning player(s). The winning player(s) are awarded the accumulated wagers or pot. Variants of Seven Card Stud Poker include "High-Low Split" in which the pot is split between the players having the highest and lowest poker rank hands and "Low-Ball" in which the player having the lowest poker rank hand wins the pot.

SUMMARY OF THE INVENTION

The present invention discloses a card game variant which enables players to compete in the familiar format of a rummy-type game, with the excitement and anticipation generated by the sequential one at a time card dealing and alternate wagering generated by Seven Card Stud Poker. In a preferred seven-card embodiment, players initially ante, then receive two cards face down and one card face up from the dealer. The player having the highest face up card then initiates a forced betting round by deciding whether to fold or make a predetermined minimum bet. Players electing to continue play after the bet or fold option each receive four more cards face up and one more card face down to complete a seven card hand. These remaining cards are dealt one at a time, with each card followed by a betting round. The point count total of the hands of the remaining players are then determined and compared, with each Ace counting 1, each deuce counting 2, etc., and with tens and face cards each counting 10. Each spread consisting of three or more suited cards in sequence or three or four of a kind counts zero (0). The object of the game is to have a lower point count total than the other players, and thus win the accumulated wagers or pot.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
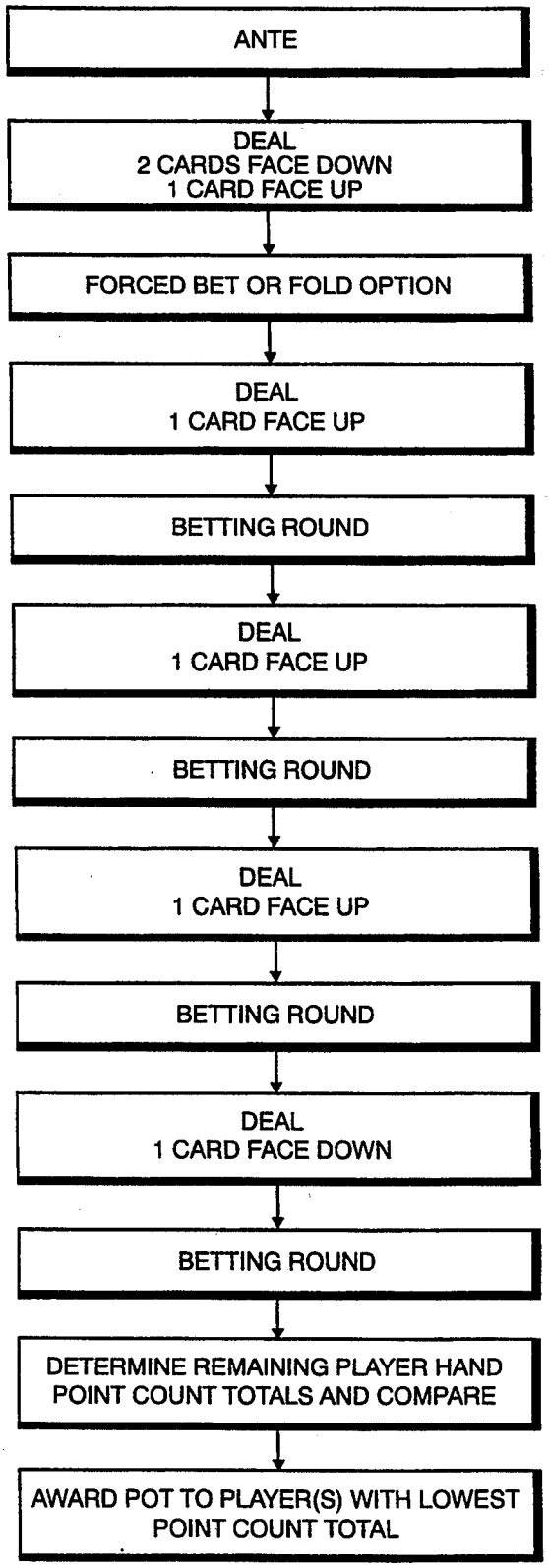
FIG. 1 is a flow chart illustrating the method of playing a card game according to the present invention.

With reference to FIG. 1, the manner of play of a preferred embodiment of the card game of the present invention will now be described. The game is principally intended to be played in a live cardroom version employing a conventional fifty-two card deck of playing cards, a live non-playing human dealer, and a gaming table surrounded by chairs for up to eight players. In the live casino version, the cards are preferably dealt from a single conventional fifty-two card deck which is reshuffled after every hand. In such a live table version, one or more players sitting or standing in respective player locations spaced about the periphery of the gaming table initially make so-called "ANTE" wagers of a predetermined amount or within a predetermined range set by the house (casino) in accordance with applicable gambling laws and regulations. In accordance with a preferred embodiment, the "ANTE" wagers are preferably 5% of a maximum predetermined bet amount. The wagers are preferably made by placing associated chips or other tokens in a central region of the table. After each player has placed the "ANTE" wager, the dealer, preferably a suitably registered and certified casino employee, then deals two cards face down and one card face up to each player in an initial three card deal. Thus, after the initial three card deal, players have knowledge of one of each of the other player's cards to assist them in subsequent wagering decisions.

After the initial three card deal, players inspect their own three cards and the one face up card of each of the other player's hands and then make a decision whether to quit the hand and forfeit their ANTE wager ("FOLD") or place an additional mandatory or forced wager to continue participating in the hand ("FORCED BET"). Preferably, the FORCED BET is an amount larger than the initial ANTE wager, for example at least 15% of the maximum allowable bet. The action in the FORCED BET round commences with the player having the highest face up card and continues in rotation around the table, with each player having the opportunity to raise or increase the bet. A limit on the number of allowable raises may be provided, for example a maximum of three raises may be allowed. For purposes of determining the high card, the cards are ranked from lowest to highest in the order Ace, 2, 3, 4, 5, 6, 7, 8, 9, 10, Jack, Queen, King, and the card suits are ranked in order from lowest to highest in the order Clubs, Diamonds, Hearts, Spades. After each player in turn has elected whether to either FOLD or make the FORCED BET, the dealer deals one additional card face up to each remaining player. This first one card deal, and each of three subsequent one card deals, is followed by a betting round commencing with the player having the lowest point count total of the face up cards. The betting rounds subsequent to the FORCED BET round allow players the option of "checking" (i.e. not folding, but not making any wager) if no other player in that round has made a bet. In determining point count totals, the cards have point values as set forth in the following table.

TABLE 1

Point Value of Cards

| Card | Point Value |
|---|---|
| Ace (any suit) | 1 |
| deuce (any suit) | 2 |
| 3 (any suit) | 3 |
| 4 (any suit) | 4 |
| 5 (any suit) | 5 |
| 6 (any suit) | 6 |
| 7 (any suit) | 7 |
| 8 (any suit) | 8 |
| 9 (any suit) | 9 |
| 10 (any suit) | 10 |
| Jack (any suit) | 10 |
| Queen (any suit) | 10 |
| King (any suit) | 10 |

For purposes of counting the point count value of a hand, any set of three or four of a kind and any suited three or more card run count zero. Aces count one point and play only low. Thus, Ace-2-3 suited comprises a run, but Ace-King-Queen suited does not.

The play continues with alternate one card deals and betting rounds until each remaining player has acquired a total of seven cards. Players may elect to FOLD and forfeit all wagers placed at any time in the hand. The first two and the last card are dealt face down, and the other four cards are dealt face up. After remaining players (those who have not folded in a previous betting round) have received the seventh card, face down, a final betting round takes place. After the final betting round, the remaining players each determine the point count total of their entire seven card hand and compare the point count total to the point count total of each of the other remaining players' hands to determine the winner. The player having the lowest point count total is the winner, and wins the pot. In the event that two or more players have hands with the same point count total value, the pot is divided equally amongst them.

Two example hands will be considered in order to convey a full and complete understanding of the game.

EXAMPLE 1.

PLAYER #1: Ace club, 5 heart, 5 diamond, 5 spade, 3 heart, J club, K heart TOTAL: 24 points PLAYER #2: Q heart, 6 heart, K spade, 8 diamond, 4 club 2 heart, 2 diamond TOTAL: 42 points PLAYER #3: 4 spade, 4 diamond, 4 heart, J club, 9 spade 8 spade, 7 spade TOTAL: 10 points (WINNER)

PLAYER #1 has a spread of three 5s which do not count in the total point value. PLAYER #2 has no spreads. PLAYER #3 has a three 4s spread and a 7-8-9 spade spread, both of which do not count in the total point value.

EXAMPLE 2.

PLAYER #1: A club, 5 heart, 5 diamond, 5 spade, 3 heart, 2 heart, A heart TOTAL: 1 point (WINNER)

PLAYER #2: Q heart, 6 heart, K heart, 8 diamond, 8 club J heart, 8 spade TOTAL: 6 points PLAYER #3: 4 spade, 4 diamond, 4 heart, J club, 9 club 10 club, 2 spade TOTAL: 2 points PLAYER #1 has a three 5s spread and an A-2-3 heart spread. PLAYER #2 has a three 8s spread and a K-Q-J heart spread. PLAYER #3 has a three 4s spread and a J-10-9 club spread.

The present invention, in addition to the live table casino version of the game described above, also contemplates an electronic video game version employing a device similar to the conventional electronic video poker device commonly employed in casinos. One such device of the general type suitable for use in the practice of the game according to the present invention is disclosed in U.S. Pat. No. 4,948,134, which issued Aug. 14, 1990, and the entire disclosure of which is incorporated by reference herein. In such an electronic video version, a player would compete against one or more "computer" hands, and "computer" and player hands would comprise card representations displayed on a video screen, with game operation controlled by suitable program instructions stored in memory chips in a manner known per se.

It is further contemplated that the game disclosed herein may include a progressive jackpot feature, as disclosed in U.S. Pat. No. 4,861,041 issued to Daniel A.

Jones and James P. Suttle on Aug. 29, 1989, the entire disclosure of which is hereby incorporated by reference herein. As described in U.S. Pat. No. 4,861,041, the progressive jackpot feature entails a separate jackpot wager, for example by placing a chip or betting token in a slot in or adjacent to the gaming table or electronic video poker machine, apart from the bets associated with the usual play of the game. If the winning hand comprises a predetermined arrangement of cards, a player selecting the winning hand wins at least a portion of the jackpot. This may be either a fixed amount of chips or tokens, or a percentage of the current jackpot total value.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A method of playing a card game, comprising the steps of:

providing a deck of playing cards including a plurality of different card suits with each suit including a plurality of cards having different point values;

dealing at least two initially incomplete player hands to at least two players, said player hands each consisting of a first predetermined number of cards;

providing an option to either place a forced minimum bet or fold to said players;

dealing a second predetermined number comprising at least one more card to each remaining player hand to form complete hands, wherein each of the remaining player completed hands consist of the same number of cards;

adding the point values of each remaining player hand according to predetermined card point values to determine a total point count value for each remaining player hand; and comparing point count total values of said remaining player hands to determine the winning player(s) between the remaining players.

2. The method of claim 1, wherein said first predetermined number of cards consists of three cards.

3. The method of claim 2, wherein said three cards consist of two face down cards and one face up card.

4. The method of claim 1, wherein said complete hands consist of seven cards.

5. The method of claim 4, wherein said seven cards consist of three face down cards and four face up cards.

6. The method of claim 1, wherein at least one card in each of said initially incomplete player hands is dealt face down.

7. The method of claim 1, wherein at least one predetermined multi-card arrangement of cards has a zero point count value.

8. The method of claim 7, wherein said deck of playing cards is divided into at least four different suits, with each suit including a plurality of sequentially denominated cards, and said predetermined multi-card arrangement comprises three or four of a kind.

9. The method of claim 8, wherein said predetermined multi-card arrangement comprises a run of three or more sequential suited cards.

10. The method of claim 1 wherein a plurality of predetermined multi-card arrangements of cards have a zero point count value.

11. The method of claim 10 wherein said deck of playing cards is divided into at least four different suits, with each suit including a plurality of sequentially denominated cards, and said plurality of predetermined multi-card arrangements of cards comprise three or four of a kind and runs of three or more sequential suited cards.

12. The method of claim 1, further comprising the step of each player placing an ante wager before said step of dealing at least two initially incomplete player hands.

13. The method of claim 1, further comprising the step of awarding accumulated wagers to said winning player(s) after said step of counting and comparing.

14. The method of claim 1, wherein said game is played in a live form on a gaming table with conventional playing cards.

15. The method of claim 1, further comprising the step of determining a player to commence each betting round by determining and comparing total point count values of face up cards of remaining player hands.

16. The method of claim 1, wherein said second predetermined number consists of four cards.

17. The method of claim 16, wherein said four cards are dealt in a one at a time manner, with each card followed by a betting round.

18. The method of claim 1, wherein at least one of said first predetermined number of cards is dealt face up and a player having the highest face up card initially faces said bet or fold option, followed in rotation by the other players.

19. A method of playing a live card game between a plurality of players, comprising the steps of:

providing a deck of playing cards including at least four different card suits, with each suit including a plurality of cards having different point values;

each of said players initially placing an ante wager;

dealing an initially incomplete player hand to each of said players consisting of two face down cards and one face up card;

providing an option to either place a forced bet or fold to each of said players;

dealing four more cards to each remaining player hand, one at a time, with each card followed by a betting round, to form completed player hands consisting of three face down cards and four face up cards;

adding the point values of each remaining player hand according to predetermined card point values to determine a total point count value for each remaining player hand;

comparing point count total values of remaining completed player hands to determine the winning player(s);

said predetermined card point count values including a plurality of predetermined multi-card arrangements of cards each having a zero point count value, said plurality of predetermined multi-card arrangements of cards comprising three or four of a kind and runs of three or more sequential suited cards; and awarding accumulated wagers to the winning player(s).

20. The method of claim 19, further comprising the step of determining a player to commence each betting round by determining and comparing total point count values of face up cards of remaining player hands.

21. A method of playing a card game, comprising the steps of:

providing a deck of playing cards including a plurality of different card suits with each suit including a plurality of cards having different point values;

dealing at least two initially incomplete player hands to at least two players, said player hands each consisting of a first predetermined number of cards;

providing an option to either place a forced minimum bet or fold to said players;

dealing a second predetermined number comprising at least one more card to each remaining player hand to form complete hands, wherein each of the remaining player completed hands consist of the same number of cards;

adding the point values of each remaining player hand according to predetermined card point values, in which at least one predetermined multi-card arrangement of cards has a zero point count value, to determine a total point count value for each remaining player hand; and comparing point count total values of said remaining player hands to determine the winning player(s) between the remaining players.

22. The method of claim 21, wherein said first predetermined number of cards consists of three cards.

23. The method of claim 22, wherein said three cards consist of two face down cards and one face up card.

24. The method of claim 21, wherein said complete hands consist of seven cards.

25. The method of claim 24, wherein said seven cards consist of three face down cards and four face up cards.

26. The method of claim 21, wherein at least one card in each of said initially incomplete player hands is dealt face down.

27. The method of claim 21, wherein said deck of playing cards is divided into at least four different suits, with each suit including a plurality of sequentially denominated cards, and said predetermined multi-card arrangement comprises three or four of a kind.

28. The method of claim 27, wherein said predetermined multi-card arrangement comprises a run of three or more sequential suited cards.

29. The method of claim 21 wherein a plurality of predetermined multi-card arrangements of cards have a zero point count value.

30. The method of claim 29 wherein said deck of playing cards is divided into at least four different suits, with each suit including a plurality of sequentially denominated cards, and said plurality of predetermined multi-card arrangements of cards comprise three or four of a kind and runs of three or more sequential suited cards.

31. The method of claim 21, further comprising the step of each player placing an ante wager before said step of dealing at least two initially incomplete player hands.

32. The method of claim 21, further comprising the step of awarding accumulated wagers to said winning player(s) after said step of counting and comparing.

33. The method of claim 21, wherein said game is played in a live form on a gaming table with conventional playing cards.

34. The method of claim 21, further comprising the step of determining a player to commence each betting round by determining and comparing total point count values of face up cards of remaining player hands.

35. The method of claim 21, wherein said second predetermined number consists of four cards.

36. The method of claim 35, wherein said four cards are dealt in a one at a time manner, with each card followed by a betting round.

37. The method of claim 21, wherein at least one of said first predetermined number of cards is dealt face up and a player having the highest face up card initially faces said bet or fold option, followed in rotation by the other players.

38. A method of playing a card game, comprising the steps of:

providing a deck of playing cards including a plurality of different card suits with each suit including a plurality of cards having different point values;

dealing at least two initially incomplete player hands to at least two players, said player hands each consisting of a first predetermined number of cards;

providing an option to either place a forced minimum bet or fold to said players;

dealing a second predetermined number comprising at least one more card to each remaining player hand to form complete hands, wherein each of the remaining player completed hands consist of the same number of cards;

adding the point values of each remaining player hand according to predetermined card point values, in which a plurality of predetermined multi-card arrangement of cards have a zero point count value, to determine a total point count value for each remaining player hand; and comparing point count total values of said remaining player hands to determine the winning player(s) between the remaining players.

39. The method of claim 38, wherein said first predetermined number of cards consists of three cards.

40. The method of claim 39, wherein said three cards consist of two face down cards and one face up card.

41. The method of claim 38, wherein said complete hands consist of seven cards.

42. The method of claim 41, wherein said seven cards consist of three face down cards and four face up cards.

43. The method of claim 38, wherein at least one card in each of said initially incomplete player hands is dealt face down.

44. The method of claim 38, wherein said deck of playing cards is divided into at least four different suits, with each suit including a plurality of sequentially denominated cards, and at least one of said plurality of predetermined multi-card arrangements comprise three or four of a kind.

45. The method of claim 44, wherein at least one other of said plurality of predetermined multi-card arrangements comprises a run of three or more sequential suited cards.

46. The method of claim 38, further comprising the step of each player placing an ante wager before said step of dealing at least two initially incomplete player hands.

47. The method of claim 38, further comprising the step of awarding accumulated wagers to said winning player(s) after said step of counting and comparing.

48. The method of claim 38, wherein said game is played in a live form on a gaming table with conventional playing cards.

49. The method of claim 38, further comprising the step of determining a player to commence each betting round by determining and comparing total point count values of face up cards of remaining player hands.

50. The method of claim 38, wherein said second predetermined number consists of four cards.

51. The method of claim 50, wherein said four cards are dealt in a one at a time manner, with each card followed by a betting round.

52. The method of claim 38, wherein at least one of said first predetermined number of cards is dealt face up and a player having the highest face up card initially faces said bet or fold option, followed in rotation by the other players.

53. A method of playing a card game, comprising the steps of:

providing a deck of playing cards including four different card suits with each suit including thirteen cards having the following predetermined card point values:

| Card | Point Value |
|---|---|
| Ace (any suit) | 1 |
| deuce (any suit) | 2 |
| 3 (any suit) | 3 |
| 4 (any suit) | 4 |
| 5 (any suit) | 5 |
| 6 (any suit) | 6 |
| 7 (any suit) | 7 |
| 8 (any suit) | 8 |
| 9 (any suit) | 9 |
| 10 (any suit) | 10 |
| Jack (any suit) | 10 |
| Queen (any suit) | 10 |

-continued

| Card | Point Value |
|---|---|
| King (any suit) | 10 |

dealing at least two initially incomplete player hands to at least two players, said player hands each consisting of a first predetermined number of cards;

providing an option to either place a forced minimum bet or fold to said players;

dealing a second predetermined number comprising at least one more card to each remaining player hand to form complete hands, wherein each of the remaining player completed hands consist of the same number of cards;

adding the point values of each remaining player hand according to said predetermined card point values to determine a total point count value for each remaining player hand; and comparing point count total values of said remaining player hands to determine the winning player(s) between the remaining players.

54. The method of claim 53, wherein at least one predetermined multi-card arrangement of cards has a zero point count value.

55. The method of claim 54, wherein said predetermined multi-card arrangement comprises three or four of a kind.

56. The method of claim 54, wherein said predetermined multi-card arrangement comprises a run of three or more sequential suited cards.

57. The method of claim 53 wherein a plurality of predetermined multi-card arrangements of cards have a zero point count value.

58. The method of claim 57 wherein said plurality of predetermined multi-card arrangements of cards comprise three or four of a kind and runs of three or more sequential suited cards.

* * * * *